US008632355B2

(12) United States Patent
Hartmann

(10) Patent No.: US 8,632,355 B2
(45) Date of Patent: Jan. 21, 2014

(54) SPRING-LOADED CONNECTION AND CONDUCTOR CONNECTION UNIT

(75) Inventor: Frank Hartmann, Minden (DE)

(73) Assignee: WAGO Verwaltungsgesellscaft mbH, Minden (DE)

( * ) Notice: Subject to any disclaimer, the term of this patent is extended or adjusted under 35 U.S.C. 154(b) by 93 days.

(21) Appl. No.: 13/365,357

(22) Filed: Feb. 3, 2012

(65) Prior Publication Data

US 2012/0208393 A1 Aug. 16, 2012

(30) Foreign Application Priority Data

Feb. 11, 2011 (DE) ..... 10 2011 011 080

(51) Int. Cl.
*H01R 4/24* (2006.01)

(52) U.S. Cl.
USPC ..... 439/411; 439/834

(58) Field of Classification Search
USPC ..... 439/410, 411, 709, 715, 828, 829, 834, 439/835
See application file for complete search history.

(56) References Cited

U.S. PATENT DOCUMENTS

| | | | | |
|---|---|---|---|---|
| 2,720,624 | A | 10/1955 | Hart | |
| 5,860,837 | A * | 1/1999 | Bock et al. | 439/828 |
| 6,283,801 | B1 * | 9/2001 | Guinda et al. | 439/835 |
| 6,893,286 | B2 * | 5/2005 | Drewes et al. | 439/441 |
| 7,083,463 | B2 * | 8/2006 | Steinkemper et al. | 439/441 |
| 7,179,137 | B1 * | 2/2007 | Quendt et al. | 439/828 |
| 7,204,727 | B2 * | 4/2007 | Germani | 439/835 |
| 7,238,043 | B2 * | 7/2007 | Reibke et al. | 439/441 |
| 7,568,939 | B2 * | 8/2009 | Diekmann | 439/438 |
| 7,862,389 | B2 * | 1/2011 | Pizzi | 439/715 |
| 7,896,686 | B2 * | 3/2011 | Hoppe | 439/441 |

FOREIGN PATENT DOCUMENTS

| | | |
|---|---|---|
| DE | 92 02 445 | 4/1992 |
| DE | 198 02 945 | 7/1999 |
| DE | 201 17 770 | 5/2002 |
| DE | 102 39 273 | 3/2004 |
| DE | 10 2004 046 471 | 2/2006 |
| DE | 20 2007 001 701 | 7/2008 |
| DE | 10 2007 051 697 | 4/2009 |
| DE | 20 2009 002 324 | 9/2010 |
| JP | 9-63664 | 7/1997 |

* cited by examiner

*Primary Examiner* — Thanh Tam Le
(74) *Attorney, Agent, or Firm* — Renner, Otto, Boisselle & Sklar, LLP

(57) ABSTRACT

The invention describes a spring-loaded connection with a busbar piece and a bent clamping spring, which has a bearing limb, a spring bend adjoining the bearing limb and a clamping limb which adjoins the spring bend opposite the transition between the bearing limb and the spring bend. The clamping limb is aligned with the busbar piece so as to form a clamping point for an electrical conductor. An actuating lug extends away from the clamping limb. The actuating lug extends from the clamping limb past the bearing limb into an actuating region located behind the bearing limb, when viewed from the clamping limb in the direction of the bearing limb. The actuating lug has, in this actuating region, an abutment for an actuating element which can be arranged in the actuating region between the bearing limb and the abutment.

10 Claims, 3 Drawing Sheets

SPRING-LOADED CONNECTION AND CONDUCTOR CONNECTION UNIT

TECHNICAL FIELD

The invention relates to a spring-loaded connection with a busbar piece and a bent clamping spring, which has a bearing limb, a spring bend adjoining the bearing limb and a clamping limb which adjoins the spring bend opposite the transition between the bearing limb and the spring bend, the clamping limb being aligned with the busbar piece so as to form a clamping point for an electrical conductor, and an actuating lug extending away from the clamping limb.

The invention furthermore relates to a conductor connection unit, for example in the form of a terminal block, a control module or a monitoring module. Terminal blocks with spring-loaded connections are sufficiently well known per se. Automation devices, for example in the form of input and/or output modules with which control and/or monitoring signals can be transmitted from and to field devices via field buses, are also sufficiently well known.

BACKGROUND OF THE INVENTION

One problem associated with spring-loaded connections is the actuation of said spring-loaded connections in order to open the clamping point.

DE 20 2007 001 701 U1 describes a universal contact with a clamping spring, which has a window cutout and, in the rest state, bears with an inner edge of the window cutout against a busbar piece. In order to plug on an electrical conductor, it is necessary for the clamping spring to be moved counter to the spring force, i.e. for the clamping spring to be opened. For this purpose, and actuating lever is provided which rests on one free end of the actuating section of a clamping spring. The bent clamping spring is formed from the actuating section, an adjoining spring bend and a bearing limb adjoining the spring bend.

A similar clamping spring which can be opened by applying pressure to the free end of the actuating section is known from DE 92 02 449 U1.

U.S. Pat. No. 2,720,634 A discloses a spring-loaded connection, in which the actuating section with a bent clamping spring can be opened by a pivotable lever.

DE 201 17 770 U1 discloses a spring-loaded terminal, in which an actuating lug which is formed integrally with a bent clamping spring protrudes laterally from the actuating section of said bent clamping spring transversely to the direction of extent of the actuating section. This actuating lug makes it possible to open the clamping spring by pivoting said clamping spring from the outside.

DE 10 2007 051 697 A1 discloses a connection terminal with a bent clamping spring, in which actuating tongues protrude transversely to the direction of extent of the actuating section from the actuating section of the clamping spring. It is possible to open the clamping springs by virtue of applying pressure to these actuating tongues.

BRIEF SUMMARY OF INVENTION

Against this background, the object of the present invention is to provide an improved spring-loaded connection which makes it possible to accommodate, inexpensively and in a space-saving manner, an actuation possibility with a space-saving installation which reduces the load on insulating housing.

The object is achieved with the spring-loaded connection of the type mentioned at the outset by virtue of the fact that the actuating lug extends from the clamping limb past the bearing limb into an actuating region located behind the bearing limb, when viewed from the clamping limb in the direction of the bearing limb, and there is provided, in this actuating region, an abutment for an actuating element which can be arranged in the actuating region between the bearing limb and the abutment.

By virtue of this actuating region which is located past the bearing limb and, when viewed from the clamping limb, behind the bearing limb, an actuation possibility is provided which is at a distance from the clamping limb. In this way, it is possible to provide good separation between the conductor insertion opening which leads to the clamping limb and the actuating opening which leads to the actuating region. A further essential advantage of the arrangement also consists in that a lever force acting between the spring bend and the abutment can be utilized for actuating the clamping spring. Thus, the clamping spring can be actuated in substantially self-supporting fashion without a substantial lever force being exerted on other component parts, in particular the insulating housing.

It is particularly advantageous if the actuating lug is arranged, over its length, adjacent to the busbar piece and follows the profile of the busbar piece. When the actuating lug is tensioned by an actuating element acting on the abutment, the actuating lug is guided along the busbar piece and therefore substantially transversely to the clamping limb aligned with the clamping point of the busbar piece.

It is particularly advantageous here if the actuating lug extends approximately parallel to the adjoining busbar piece.

Preferably, the busbar piece has a conductor leadthrough opening, into which the clamping spring is inserted in such a way that at least the clamping limb dips into the conductor insertion opening. The conductor leadthrough opening can preferably be in the form of a material passage with walls which are closed on at least three sides and which extend from the plane of the busbar piece downwards in the conductor plug-in direction, i.e. transversely to the plane of the busbar piece.

It is also conceivable here for the bearing limb also to dip into the conductor insertion opening and to bear against a narrow side of the conductor leadthrough opening. On the other hand, the clamping limb forms a clamping point with the opposite narrow side of the conductor leadthrough opening, which is preferably set forward from the adjoining regions of the narrow side in the direction of the opposite narrow side.

In the context of the present invention, the expression "dip into" is also understood to mean "pass through", so that the end of the clamping limb protrudes out of the conductor leadthrough opening downwards again.

It is particularly advantageous if the actuating lug has a window cutout, through which the bearing limb is passed. In this case, the actuating lug can be formed from peripheral webs which are cut or stamped free from the clamping limb and are bent back from the clamping limb in the direction of the bearing limb.

In an alternative embodiment, the bearing limb can have a window cutout, wherein the actuating lug is passed through the window cutout.

The actuating lug is preferably formed integrally with the clamping spring and bent out from the actuating section of the clamping spring. Thus, the clamping spring can be produced together with the actuating lug in a simple and material-saving manner. For this purpose, the actuating section can be formed, for example, as mentioned above, by peripheral webs being cut/stamped free from the clamping limb and the clamping limb end being cut free. The clamping spring can then be bent as desired by single-stage or multiple-stage reshaping methods.

Furthermore, the object is achieved by a conductor connection unit in particular in the form of a terminal block, a control module and/or monitoring module, (i.e. an automation device, in particular modular automation devices), with an insulating housing and with at least one above-described spring-loaded connection. An actuating opening which leads into the actuating area between the bearing limb and the abutment and is provided for receiving an actuating element, is provided in the insulating housing. The actuating element may be, for example, a screwdriver which can be inserted if required. However, it is also conceivable for an actuating element, for example consisting of a polymeric material, to be installed in the actuating opening such that it is mounted displaceably or rotatably.

The actuating opening is preferably designed in such a way that the actuating element on the abutment can be supported directly or indirectly on the spring bend and the clamping spring can be deflected by a pivoting movement of the actuating element about the point at which it bears directly or indirectly against the spring bend. This has the advantageous effect that the lever force acting during actuation of the clamping spring acts between the abutment and the spring bend and the other components, such as in particular the insulating housing, are subjected to barely any load.

BRIEF DESCRIPTION OF DRAWINGS

The invention will be explained in more detail below with reference to an exemplary embodiment with the attached drawings, in which.

DETAILED DESCRIPTION OF INVENTION

Figure 1:
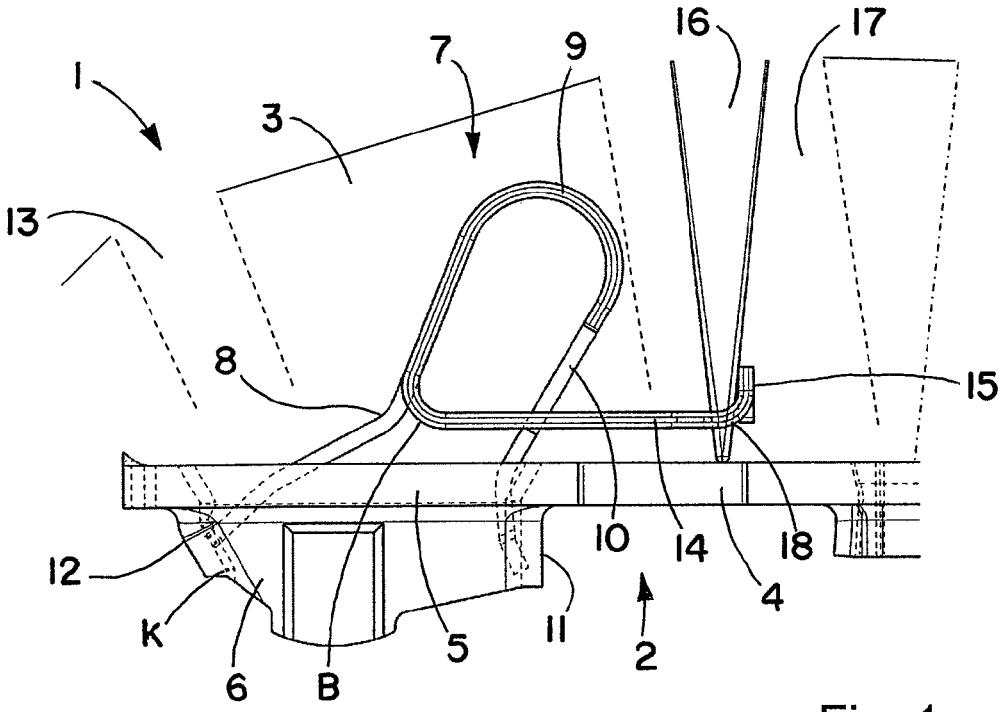
FIG. 1—shows a sketch of a conductor connection unit with a spring-loaded connection in the unactuated state in a side view.

FIG. 1 shows a sketch of a detail of a conductor connection unit 1 with a spring-loaded connection 2, which is installed in an insulating housing 3. The insulating housing 3 is illustrated only symbolically by dashed lines.

The spring-loaded connection 2 has a busbar piece 4 with a conductor leadthrough opening 5. The conductor leadthrough opening 5 is in the form of a material passage with side walls 6 pointing downwards from the plane of the busbar piece 4. The side walls 6 form a cage which is closed on at least three sides, in this case in the form of a ring, for example, for guiding an electrical conductor and conducting electrical current with a clamping point K. The clamping point K is formed on a narrow side wall 12 of the conductor leadthrough opening 5 and is set forward with respect to the section of the conductor leadthrough opening 5 lying thereabove in the direction of the opposite side wall 11. This predetermines precisely a contact area with as small dimensions as possible onto which the force of the clamping spring is fixed.

It can be seen that a clamping spring 7 which has, in a manner known per se, a clamping limb 8, an adjoining spring bend 9 and a bearing limb 10, which extends further from the spring bend, is inserted into the conductor leadthrough opening 5. The free end of the bearing limb 10 dips into the conductor leadthrough opening 5 and is supported on the narrow side 11 or narrow side wall of the conductor leadthrough opening which is opposite the clamping point K.

The clamping limb 8 also dips with its free end into the conductor leadthrough opening 5. This also includes a situation in which the clamping limb end passes through the conductor leadthrough opening 5 and protrudes downwards out of the conductor leadthrough opening 5. The end of the clamping limb 8 forms, together with the clamping point K on the inclined narrow side wall 12, a clamping edge for an electrical conductor (not illustrated) which is inserted from above through a conductor leadthrough opening 13 in the insulating housing 3. That end of such an electrical conductor from which the insulation has been stripped is then gripped on one side by the free end of the clamping limb 8 of the clamping spring 7 and pressed against the clamping point K, as is sufficiently well known per se.

Figure 2:
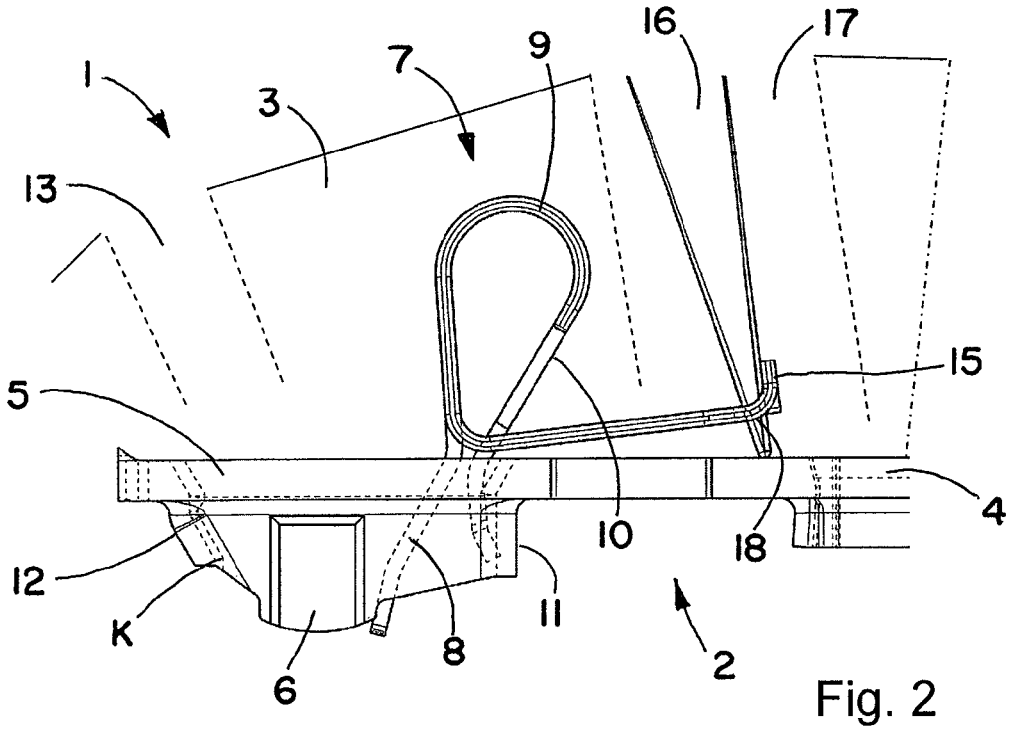
FIG. 2—shows a sketch of a conductor connection unit with a spring-loaded connection in the actuated state in a side view.

In order to remove the electrical conductor, the spring-loaded connection 7 needs to be opened. Such an opening operation is also useful, under certain circumstances, when inserting an electrical conductor in order to make a terminal connection therewith. For this purpose, an actuating lug 14 is provided which extends starting from the clamping limb 8, in the direction of the bearing limb 10 and furthermore away from the clamping point K. The end of the actuating lug 14 is located in a region, when viewed from the clamping point K or the clamping edge there, beyond the spring bend 9 and the bearing limb 10 viewed rear region of the clamping spring 7. The free end of the actuating lug (14) is bent upwards and has an abutment 15 for an actuating element 16 there. The figure shows that a screwdriver is inserted as actuating element 16 into an actuating opening 17 in the insulating housing 3 and is plugged with its end through an opening 18 in the actuating lug 14. In this case, the actuating element 16 bears against the abutment 15 and allows a tensile force to be exerted on the actuating lug 14. As a result, the clamping limb 8 is drawn in the direction of the bearing limb 10 and the clamping spring 7 is opened, as is illustrated in FIG. 2. It can be seen that the actuating lug 14 in the unactuated state extends substantially parallel to the plane of the busbar 5. When the clamping spring 7 is deflected, the end of the actuating lug 14 with the abutment 15 tips upwards away from the plane of the busbar 5, with the result that the actuating lug 14 is then at an angle to the busbar 5. This angle may be approximately 15 to 25°.

For the deflection of the clamping spring 7, it is advantageous if the actuating lug 14 adjoins the clamping limb 8 at a bend B. The bending radius of this bend B should be as large as possible in order to reduce the bending stress. However, in this case the bending radius should not be selected to be so great that a dedicated spring element is formed and the clamping limb 8 no longer moves to a sufficient extent owing to the resilient bend B. A bending radius of approximately 5 to 1.5 mm is advantageous, preferably approximately 1 mm.

By virtue of the actuation of the clamping spring 7 being moved into the region behind the spring bend 9, the spring bend 9 is used as an opposing bearing for the lever of the actuating element 16, said lever acting between the spring bend 9 and the abutment 15.

An essential advantage of the actuating lug 14 with the actuating area located in the rear region consists in that a transmission for the actuation is provided at which a large excursion of the end of the clamping limb 8 can be realized on a short distance or small angle of the abutment 15 from the actuated position to the unactuated position.

Figure 3:
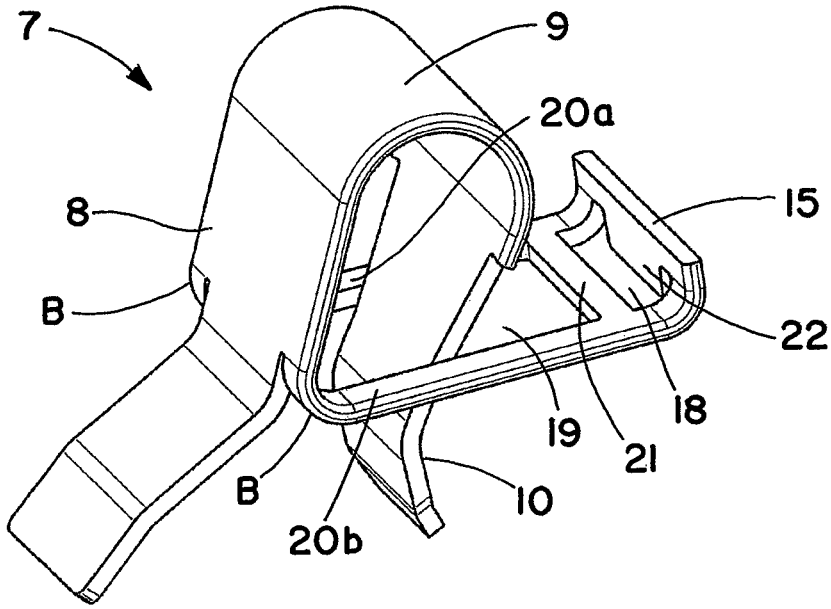
FIG. 3—shows a perspective view of a clamping spring for the spring-loaded connection shown in FIGS. 1 and 2.

FIG. 3 shows a perspective view of a clamping spring 7, which is inserted in the spring-loaded connection 2 shown in FIGS. 1 and 2. It can be seen here that the fastening lug 14 has a window cutout 19, through which the bearing limb 10 is passed. This window cutout 19 has been produced by stamping or cutting peripheral webs 20*a*, 20*b* free from the strip-like spring material provided per se for the clamping limb 8. These peripheral webs 20*a*, 20*b* are connected to one another again at the end of the window cutout 19 by a transverse web 21. The transverse web 21 is opposite the bend B, at which the peripheral webs 20*a*, 20*b* merge to become the clamping limb 8. The cross section 21 is adjoined by the opening 18, which is formed by a material tab 22 being cut or stamped free. The material tab 22 is directed downwards when the abutment 15 is bent upwards and is set transversely, and said material tab thus increases the area available for the abutment 15. In addition, the point of action for an actuating element 16 through the material tab 22 is moved downwards as far as possible. Thus, the length of the lever arm is increased to a maximum extent.

It can also be seen that the clamping limb 8 adjacent to the bend B is bent out and bent again at the free end. This results in improved clamping properties by virtue of improved transmission of the spring force via the clamping limb 8 to the electrical conductor. In particular as a result of the bending of the clamping limb end downwards, the opening excursion is enlarged in comparison with a clamping limb end which is not bent downwards again and the angle of intervention of the clamping limb end on an electrical conductor is improved.

Figure 4:
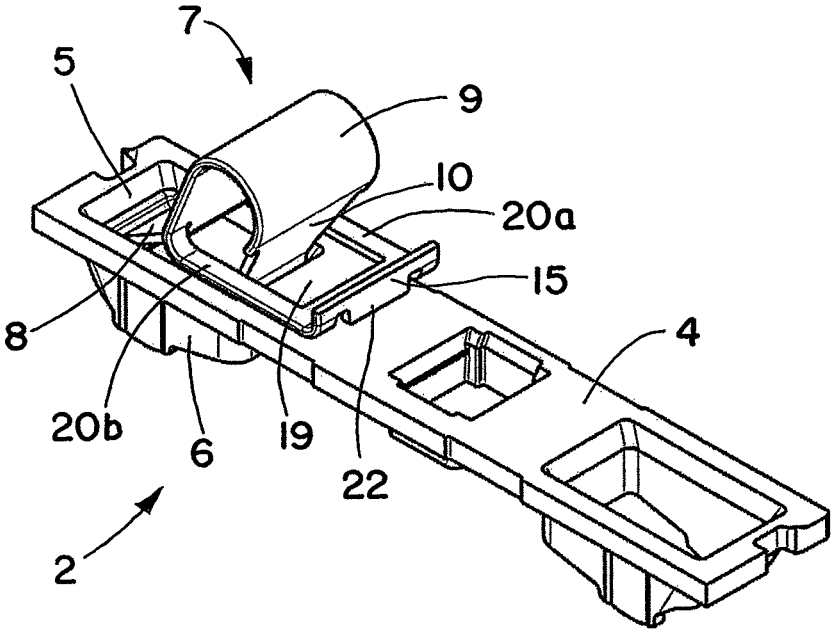
FIG. 4—shows a perspective view of the spring-loaded connection shown in FIG. 1 in the unactuated state.

FIG. 4 shows a perspective view of the spring-loaded connection shown in FIG. 1. It can be seen that the clamping spring 7 dips with the bearing limb 10 and the clamping limb 8 into the conductor leadthrough opening 5 in the busbar piece 4, with the result that the clamping spring with the bearing limb 10 is mounted fixedly on the busbar piece 4.

It can also be seen that the actuating lug 14 extends from the clamping limb 8 past the bearing limb 10 into an actuating region located behind the bearing limb 10, when viewed from the clamping limb 8 in the direction of the bearing limb 10. The abutment 15 for an actuating element is located in this rear actuating region.

It is also clear that the bearing limb 10 is passed through the window cutout 19 in the actuating lug 14.

Figure 5:
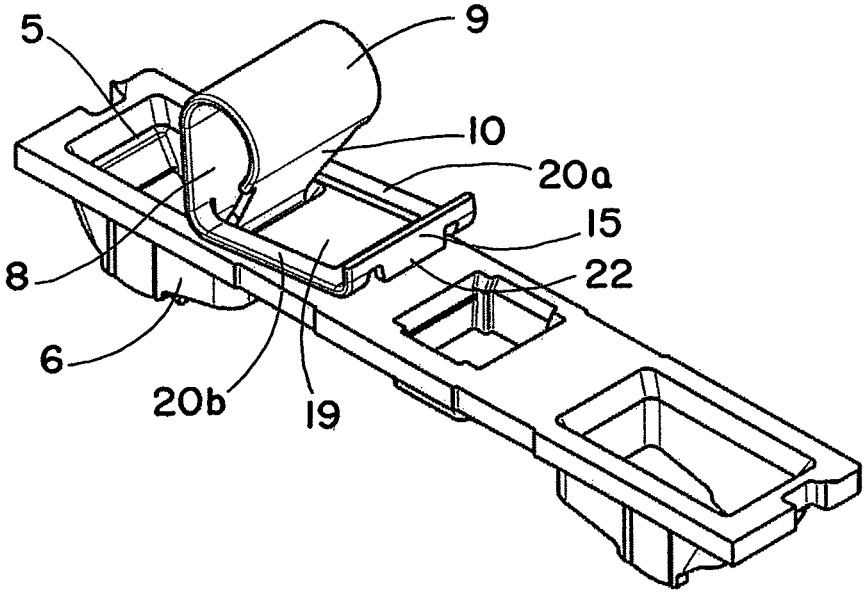
FIG. 5—shows a perspective view of the spring-loaded connection shown in FIG. 2 in the actuated state.

FIG. 5 shows the spring-loaded connection 2 shown in FIG. 4 in the actuated state, in which the clamping point is open. For this purpose, the abutment 15 has been moved away from the bearing limb 10 and the conductor leadthrough opening 5 by virtue of a tensile force acting on the actuating lug 14.

The invention claimed is:

1. A Spring-loaded connection comprising:

a busbar piece;

a bent clamping spring, which has a bearing limb, a spring bend adjoining the bearing limb and a clamping limb which adjoins the spring bend opposite the transition between the bearing limb and the spring bend, the clamping limb being arranged relative to the busbar piece so as to form a clamping point for an electrical conductor; and an actuating lug extending away from the clamping limb wherein the actuating lug extends from the clamping limb past the bearing limb into an actuating region located behind the bearing limb, when viewed from the clamping limb in the direction of the bearing limb, and has, in the actuating region, an abutment for an actuating element which can be arranged in the actuating region between the bearing limb and the abutment.

2. The Spring-loaded connection according to claim 1, wherein the actuating lug is arranged, over a length of the actuating lug, adjacent to the busbar piece and follows a profile of the busbar piece.

3. The Spring-loaded connection according to claim 2, wherein the actuating lug extends approximately parallel to the busbar piece.

4. The Spring-loaded connection according to claim 1, wherein the busbar piece has a conductor leadthrough opening and the clamping spring is inserted into the conductor leadthrough opening in such a way that at least the clamping limb dips into the conductor leadthrough opening.

5. The Spring-loaded connection according to claim 1, wherein the actuating lug has a window cutout, and the bearing limb is passed through the window cutout.

6. The Spring-loaded connection according to claim 1, wherein the abutment is formed from a section of the actuating lug, said section of material being bent out and protruding from a plane of the actuating lug.

7. The Spring-loaded connection according to claim 1, wherein the actuating lug is formed integrally with the clamping spring and is bent out from the clamping limb of the clamping spring.

8. A Conductor connection unit, comprising:

an insulating housing; and the at least one spring-loaded connection according to claim 1 arranged in the insulating housing, wherein an actuating opening leading into an actuating area between the bearing limb and the abutment is provided in the insulating housing for receiving the actuating element.

9. The Conductor connection unit according to claim 8, wherein the actuating opening is designed in such a way that the actuating element acting on the abutment can be supported directly or indirectly on the spring bend and the clamping spring can be deflected by pivoting movements of the actuating element about the point at which the actuating element bears directly or indirectly against the spring bend.

10. The Conductor connection unit according to claim 9, wherein the conductor connection unit comprises a terminal block, control module and monitoring module.

* * * * *